US006445138B1

(12) United States Patent
Barry et al.

(10) Patent No.: US 6,445,138 B1
(45) Date of Patent: Sep. 3, 2002

(54) MICROWAVE POWERED LAMP WITH IMPROVED COOLING SYSTEM

(75) Inventors: Jonathan David Barry, Frederick, MD (US); Ernest G. Penzenstadler, Herndon, VA (US); Edmund F. Davis, Gaithersburg, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 09/805,504

(22) Filed: Mar. 14, 2001

(51) Int. Cl.[7] ..... H05B 41/16

(52) U.S. Cl. ..... 315/248; 315/39.51; 315/118; 315/344

(58) Field of Search ..... 315/248, 112, 315/85, 118, 39.51, 267, 344; 313/22, 35, 45, 46

(56) References Cited

U.S. PATENT DOCUMENTS

| | | | | | |
|---|---|---|---|---|---|
| 3,872,349 | A | | 3/1975 | Spero et al. | 315/39 |
| 4,324,631 | A | * | 4/1982 | Meckel et al. | 204/192.2 |
| RE32,626 | E | | 3/1988 | Yoshizawa et al. | 315/39 |
| 4,728,522 | A | | 3/1988 | Wear et al. | 426/242 |
| 4,785,726 | A | | 11/1988 | Wear et al. | 99/451 |
| 5,070,277 | A | * | 12/1991 | Lapatovich | 313/234 |
| 5,471,109 | A | | 11/1995 | Gore et al. | 313/22 |
| 5,866,990 | A | | 2/1999 | Ury et al. | 315/248 |
| 5,998,934 | A | | 12/1999 | Mimasu et al. | 315/118 |
| 6,064,047 | A | * | 5/2000 | Izzo | 219/687 |
| 6,351,087 | B1 | * | 2/2002 | Katase et al. | 315/344 |

* cited by examiner

*Primary Examiner*—Haissa Philogene
(74) *Attorney, Agent, or Firm*—Antonelli, Terry, Stout & Kraus, LLP

(57) ABSTRACT

A air provided microwave powered lamp (100) and an assembly (300) of a microwave powered lamp. A microwave, powered lamp includes a housing (22) containing a water cooled magnetron (110), the water cooled magnetron providing microwaves to a microwave excited bulb, the microwave excited bulb 16 providing light from the housing; an air source (18), coupled to the housing, which blows air (20) to the water cooled magnetron and the lamp with the air providing cooling to the bulb to control operation temperature thereof; a heat exchanger (102), disposed in the housing, with the air blown from the air source contacting the heat exchanger, the heat exchanger having a portion contacted by water heated by operation of the water cooled magnetron with the air blown from the air source cooling the heated water, and a water circulation circuit (104), coupled to the water cooled magnetron and the portion of the heat exchanger, which circulates heated water from the water cooled magnetron to the portion of the heat exchanger and cooled water from the portion of the heat exchanger back to the water cooled magnetron,

38 Claims, 3 Drawing Sheets

MICROWAVE POWERED LAMP WITH IMPROVED COOLING SYSTEM

BACKGROUND OF THE INVENTION

The present invention relates to microwave powered lamps having improved cooling of magnetrons therein.

DESCRIPTION OF THE PRIOR-ART

FIG. 1 illustrates a prior art microwave powered lamp 10 of the type sold by the Assignee of the present invention, The microwave powered lamp may be used to produce ultraviolet (UV) or visible light depending on the application such as, but not limited to, curing surface coatings. A magnetron 12 provides microwaves transmitted through a microwave cavity 14 to a microwave powered bulb 16 which outputs light as stated above in either the UV or visible spectrum depending upon the application. An air source 18 blows air 20 through a housing 22 which contains the magnetron 12, microwave cavity 14. and microwave excited bulb 16. As indicated, air 20 flows through the housing around the magnetron 12 to provide cooling thereof and into the microwave cavity 14 and to and around the bulb 16 to provide cooling of the bulb. The lamp housing 22 is designed to channel air 20 in contact with cooling fins (not illustrated) of the magnetron 12, through openings 24 and then through openings (not illustrated) of reflector 26 past the bulb 1 6 as described above and out of the housing 22. The air 20, which is heated by the magnetron 12 and the bulb 16, exits through the opening 29 through which the light is also outputted after being reflected by reflector 28.

The power of the light output produced by the bulb 18 is limited by the cooling of the magnetron 12. The anode (not illustrated) of the magnetron 12 is maintained during operation at a temperature of around 180 EC by the air 20 which is blown past the cooling fins. A three kilowatt magnetron is currently the maximum power commercially available magnetron which may be air cooled.

Water cooled magnetrons have been developed which have a water channel mounted in thermal contact with the outside of the anode instead of the aforementioned cooling fins utilized with the air cooled magnetron 10 of FIG. 1. Water is pumped through the water channel to cool the magnetron. The use of water to cool the magnetron is a much more effective cooling mechanism than air cooling and permits the anode temperature to be maintained at the much lower operating temperature of about 90 EC. A lower operating temperature increases the magnetron life which signiflcantly reduces the customer's cost of ownership for the microwave powered lamp. Furthermore, water cooled magnetrons permit the use of higher input microwave power to the bulb which provides a higher power light output per linear inch of the microwave excited lamp.

Historically, water cooled magnetrons used in microwave excited lamps require an operator provided external source of cooling water for each microwave lamp, such as from an external water circulating system, fabricated to the site requirements of the microwave excited lamps. The required plumbing to add the external water circulating system substantially increases the cost to the operator to have a water cooled microwave excited lamp.

SUMMARY OF THE INVENTION

The present invention is an improved microwave powered lamp which utilizes a water cooled magnetron having a water supply circuit integrated into the microwave powered lamps. The integration of the water supply circuit into the microwave powered lamp eliminates the problem of the prior art which required an external water circulation circuit. The present invention uses a single forced air source to cool the heated water produced from cooling the magnetron and the microwave excited bulb. As a result, the entire assembly of a microwave powered lamp, including a water cooled, magnetron in accordance with the invention, is totally integrated with the microwave lamp which permits low cost installation including a group of water cooled microwave excited lamps ganged together. One or more water-cooled microwave excited lamps may be installed for curing applications to provide higher power light output, when compared to air cooled microwave excited lamps, without any consideration being given to providing an external water supply and/or cooling thereof.

The microwave powered lamp of the invention includes a housing containing a water cooled magnetron; an air source which blows air to the magnetron and the microwave excited bulb with the air providing cooling to the bulb to control the operational temperature thereof; and a heat exchanger disposed in the housing, with air blown from the air source contacting the heat exchanger. A portion of the heat exchanger is contacted by water heated by operation of the magnetron with air blown from the air source cooling the heated water. A water circulation circuit circulates heated water from the water cooled magnetron to the portion of the heat exchanger and cooled water from the portion of the heat exchanger back to the magnetron. The aforementioned water cooled microwave excited lamp may be ganged into an assembly containing multiple water cooled microwave excited lamps which each are self-contained which permits an in-line assembly of multiple microwave powered lamps all having integrated water cooling for curling an in-line target The heat exchanger may be a radiator similar to that found in an automobile heater core with the cooling air being blown through the heater core to cool the water and then blown into the microwave cavity and through the reflector to cool the microwave excited bulb. Water flow is maintained continuously through the magnetron and the heater core using a water pump and overflow holding tank which are sized for the cooling requirements of the magnetron and may be In typical applications small and integrally mounted to the exterior of the housing of the microwave excited lamp permitting the entire assembly to be deployed without any external water connections as a single unit or a ganged assembly.

The invention provides a substantial reduction in anode temperature of the magnetrons, such as approximately 50% in a typical UV curing application, with no increase in forced cooling air requirements to provide the increased cooling of the magnetron beyond the cooling air requirement utilized for an air cooled magnetron having a substantially lower power light output. Furthermore. the life of the magnetrons is substantially increased. The extension in operating life is in general proportional to the reduction in the operating temperature, e.g. from the normal 180 EC of an air cooled magnetron, to approximately 90 EC for a water cooled magnetron, may result in doubling the life of the magnetron. Furthermore, in a preferred commercial application, a five to six kW commercially available water cooled magnetron may be utilized to excite a bulb producing a substantially higher light output.

The invention is a microwave powered lamp including a housing containing a water cooled magnetron, the water cooled magnetron providing microwaves to a microwave excited bulb, the microwave excited bulb providing light from the housing; an air source, coupled to the housing, which blows air to the water cooled magnetron and the bulb with the air providing cooling to the bulb to control operational temperature thereof; a heat exchanger, disposed in the housing, with the air blown from the air source contacting the heat exchanger, the heat exchanger having a portion contacted by water heated by operation of the magnetron with the air blown from the air source cooling the heated water; and a water circulation circuit, coupled to the water cooled magnetron and the portion of the heat exchanger, which circulates heated water from the water cooled magnetron to the portion of the heat exchanger and cooled water from the portion of the heat exchanger back to the magnetron. The portion of the heat exchanger may be a core through which water flows and the heat exchanger may be a radiator having openings through which the air flows within the housing. A water pump may be coupled to a water tank with the heated water being pumped from the water cooled magnetron through a conduit of the water circulation circuit to the portion of the heat exchanger and the cooled water being pumped from the portion of the heat exchanger through a conduit of the water circulation to one of the water tank and the water pump and the cooled water may be pumped by the pump through a conduit of the water circulation to the water cooled magnetron circuit. The water pump and water tank may be located outside the housing, The air source may be a single air blower which provides all air blown in the housing to the water cooled magnetron and to the bulb. The rate of blowing air through the housing may be chosen to maintain operation of the bulb within a temperature range within which the bulb of the lamp is designed to operate and a rate of water flow through the water circulation circuit may be chosen to maintain operation of the water cooled magnetron within a temperature range within which the water cooled magnetron is designed to operate. The bulb may be a UV bulb.

The invention is also an assembly of microwave powered lamps having the lamps therein in line. Each of the microwave powered lamps includes a housing containing a water cooled magnetron, the water cooled magnetron providing microwaves to a microwave excited bulb, the microwave excited bulb providing light from the housing; an air source, coupled to the housing, which blows air to the water cooled magnetron and the bulb with the air providing cooling to the bulb to control operational temperature thereof, a heat exchanger, disposed in the housing, with the air blown from the air source contacting the heat exchanger, the heat exchanger having a portion contacted by water heated by operation of the water cooled magnetron with the air blown from the air source cooling the heated water; and a water circulation circuit, coupled to the water cooled magnetron and the portion of the heat exchanger, which circulates headed water from the water cooled magnetron to the portion of the heat exchanger and cooled water from the portion of the heat exchanger back to the magnetron. In each microwave powered lamp, the portion of the heat exchanger maybe a core through which water flows and the heat exchanger may be a radiator having openings through which the blown air flows within the housing. In each microwave powered lamp the water circulation circuit may comprise a water pump coupled to a water tank with the heated water being pumped from the water cooled magnetron through a conduit of the water circulation circuit to the portion of the heat exchanger and the cooled water may be pumped from the portion of the heat exchanger through a conduit of the water circulation circuit to one of the water tank and the water In the tank and the cooled water may be pumped by the pump from the water tank through a conduit of the water circulation circuit to the water cooled magnetron. In each microwave powered lamp, the water pump and water tank may be outside the housing, In each microwave powered lamp, the air source may be a single air blower which provides all air blown in the housing to the water cooled magnetron and to the bulb. In each microwave powered lamp, the rate of blowing air through the housing may be chosen to maintain operation of the bulb within a temperature range within which the bulb is designed to operate and a rate of water flow through the water circulation circuit may be chosen to maintain operation of the water cooled magnetron within a temperature range within which the water cooled magnetron is designed to operate. In each microwave powered lamp the bulb may be a UV bulb.

BRIEF DESCRIPTION OF THE DRAWINGS

Like reference numerals identify like parts throughout the drawings.

DESCRIPTION OF THE-PREFERRED EMBODIMENTS

Figure 1:
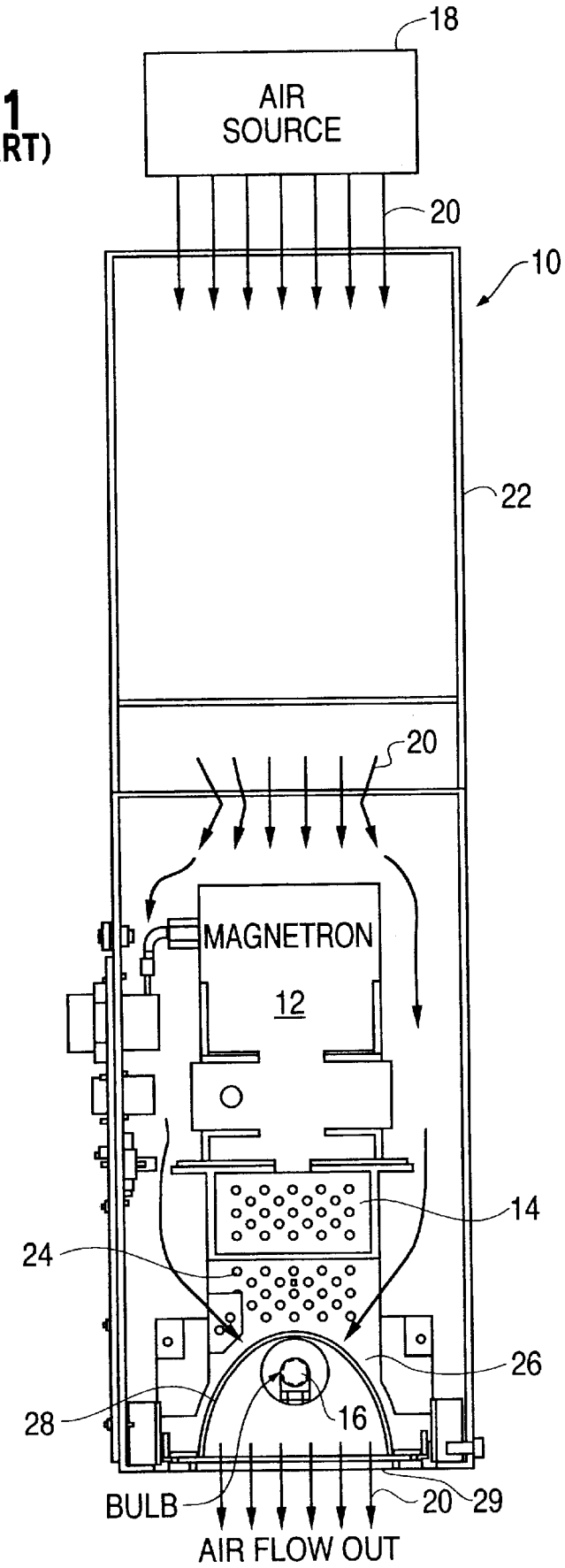
FIG. 1 (PRIOR ART)
FIG. 1 illustrates a prior art air cooled microwave powered lamp having air cooling for both the magnetron and the bulb therein.
Figure 2:
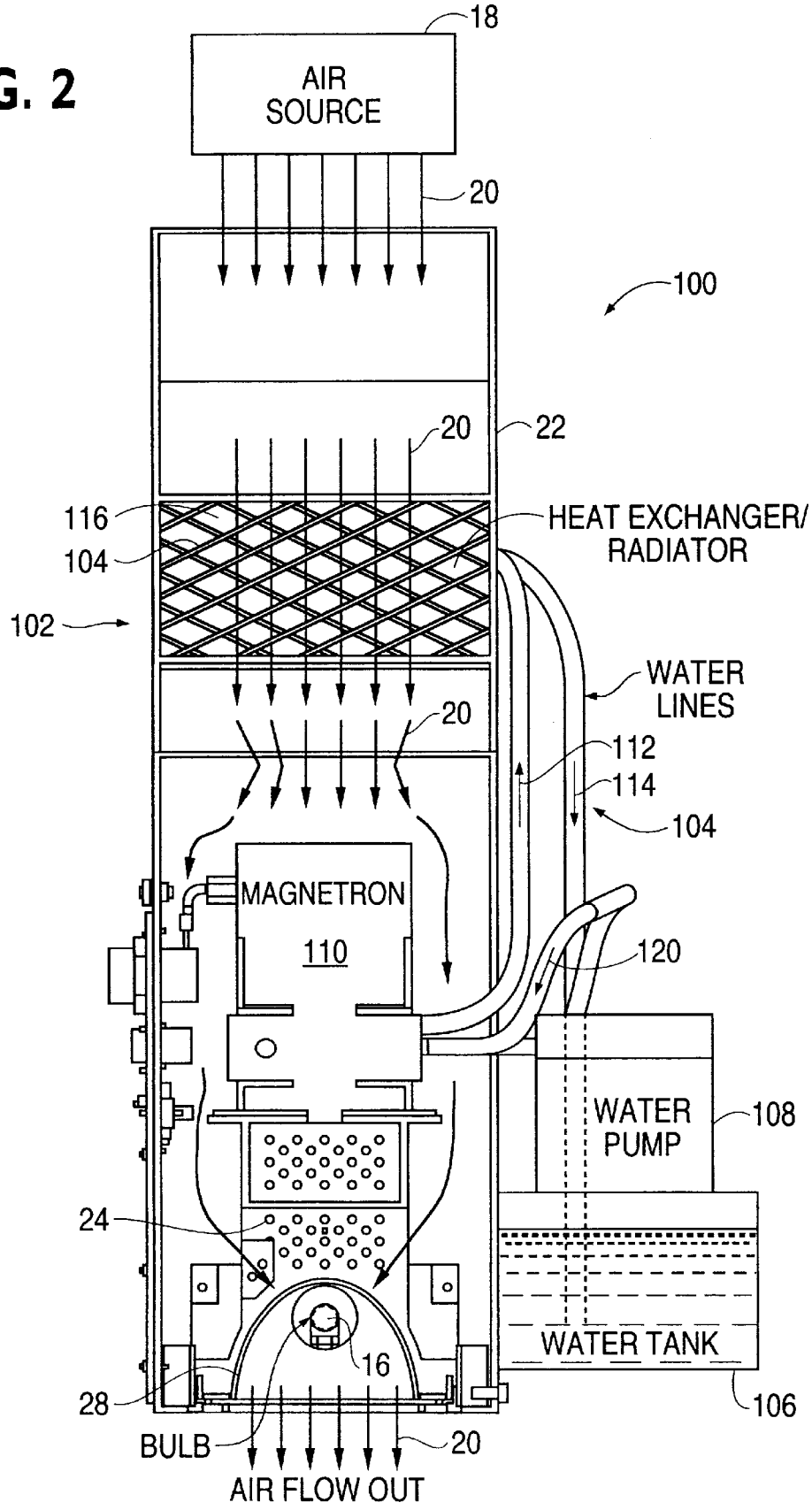
FIG. 2 illustrates a microwave powered lamp in accordance with the invention having a water cooled magnetron and an air cooled bulb which utilizes the housing of the prior art of FIG. 1.

FIG. 2 illustrates an embodiment 100 of a microwave powered lamp in accordance with the present invention. The embodiment 100 is based upon the housing 22 of the prior art of FIG. 1 but has been modified to contain a water cooled magnetron 110 therein, a heat exchanger/radiator 102 mounted within the housing, a water circulation circuit 104, a water tank 106 and a water pump 108. The magnetron 110 may be any in accordance with any known water cooled magnetron having a water channel mounted in thermal contact with the outside surface of the anode (not illustrated) While a preferred embodiment of the present invention utilizes the same housing as the prior art of FIG. 1, it should be understood that the present invention is not limited thereto and may be practiced with diverse housing designs not based upon air cooled magnetrons used to excite microwave powered bulbs.

The operation of the embodiment 100 is as follows. Light is produced by the bulb 16 and is reflected by the reflector 28 which may be a parabola or other reflecting surface depending upon the application. Heat exchanger 102 is disposed in housing 20 and includes a core 104 through which water flows, The heat radiator/exchanger 102 functions as radiator to transfer heat from heated water 112 exiting the water cooled magnetron 110. The heated water 112 flows to the heat exchange radiator 102 and through the core 104 and back as cooled water 114 to water tank 106. Water pump 108 supplies the pressure head necessary to maintain the flow of heat water 112 and cooled water 114 between the magnetron 110 and the heat exchanger/radiator 102. The air 20 blowing through the openings 116 transfers heat from the heated water 112 to the air 20 which flows downward in the chamber 22 beyond the heat exchanger/radiator as illustrated. The heated air 20, while being of a higher temperature than that encountered in the prior art of FIG. 1. nevertheless is substantially cooler than the operating temperature of bulb 18 which operates at temperatures between 800–900 EC in typical applications. Therefore. the heated air flowing the past the magnetron has more than sufficient cooling capacity to cool the bulb 16 to operate within a temperature range within which the bulb 16 of the lamp is designed to operate. The rate of water flow 120 to the magnetron 110, which typically is from the holding tank 108 (but may be reversed to be directly from the water pump 108). is chosen to maintain operation of the magnetron 11 within a temperature range within which the magnetron is designed to operate, The aforementioned configuration utilizes a single air source 18 to maintain the temperature of the bulb 16 within the desired operating temperature range. The water circulation circuit 104 is designed to maintain operation of the magnetron within a temperature range within which the magnetron is designed to operate. As a result, higher light output is produced by the bulb 16 in view of the increased microwave excitation power coupled thereto by the higher microwave output power produced by the water cooled magnetron 110 as compared to the prior art air cooled magnetron 12.

The overall microwave powered lamp has a single air source 18 and a water tank 106 and water pump 108 integral with the housing 22 which permits the entire microwave powered lamp to be Installed for applications without any external connections for water cooling as in the prior art.

Figure 3:
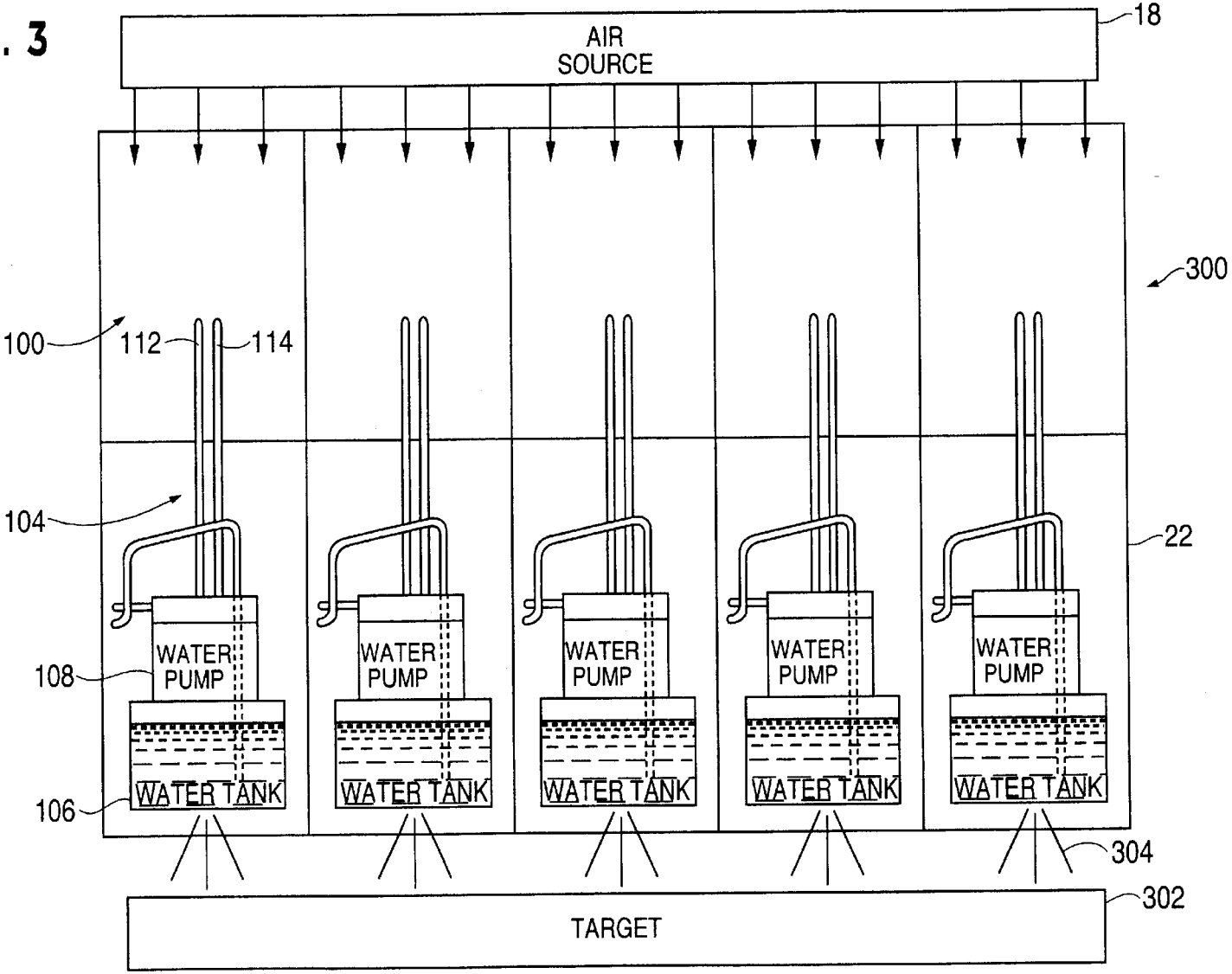
FIG. 3 illustrates an assembly of microwave powered lamps each in accordance with FIG. 2.

FIG. 3 Illustrates an assembly 300 of microwave powered lamps 100. which are ganged together, with the lamps being in line to permit a target 302 to be irradiated with the light output 304 in line such as may be without limitation used in typical UV curing applications. As is apparent, the modular construction of microwave powered lamps 100 provides an in-line assembly of any desired length without any external water cooling requirement as a result of the water flow of each microwave powered lamp being self-contained within the housing 22 thereof in accordance with FIG. 2. The use of the invention as an assembly of water cooled microwave excited lamps is not limited to In-line applications.

While the Invention has been described in terms of the preferred embodiments thereof, it should be understood that numerous modifications may be made thereto without departing from the spirit and scope of the invention. It is intended that all such modifications fall within the scope of the appended claims.

What is claimed is:

1. A microwave powered lamp comprising:

a housing containing a water cooled magnetron, the water cooled magnetron providing microwaves to a microwave excited bulb, the microwave excited bulb providing light from the housing;

an air source, coupled to the housing, which blows air to the water cooled magnetron and the bulb with the air providing cooling to the bulb to control operation temperature thereof;

a heat exchanger disposed in the housing, with the air blown from the air source contacting the heat exchanger, the heat exchanger having a portion contacted by water heated by operation of the magnetron with the air blown from the air source cooling the heated water; and a water circulation circuit, coupled to the water cooled magnetron and the portion of the heat exchanger, which circulates heated water from the water cooled magnetron to the portion of the heat exchanger and cooled water from the portion of the heat exchanger back to the magnetron.

2. A microwave powered lamp in accordance with claim 1 wherein:

the portion of the heat exchanger is a core through which water flows and the heat exchanger is a radiator having openings through which the air flows within the housing.

3. A microwave powered lamp in accordance with claim 1 wherein the water circulation circuit comprises:

a water pump coupled to a water tank with the heated water being pumped from the water cooled magnetron through a conduit of the water circulation circuit to the portion of the heat exchanger and the cooled water being pumped from the portion of the heat exchanger through a conduit of the water circulation to one of the water tank and the water pump and the cooled water being pumped by the pump through a conduit of the water circulation circuit to the water cooled magnetron circuit.

4. A microwave powered UV lamp in accordance with claim 2 wherein the water circulation circuit comprises:

a water pump coupled to a water tank with the heated water being pumped from the water cooled magnetron through a conduit of the water circulation circuit to the portion of the heat exchanger and the cooled water being pumped from the portion of the heat exchanger through a conduit of the water circulation to one of the water tank and the water pump and the cooled water being pumped by the pump through a conduit of the water circulation circuit to the water cooled magnetron circuit.

5. A microwave powered lamp in accordance with claim 3 wherein:

the water pump and water tank are located outside the housing.

6. A microwave powered lamp in accordance with claim 4 wherein:

the water pump and water tank are located outside the housing.

7. A microwave powered lamp in accordance with claim 1 wherein:

the air source is a single air blower which provides all air blown in the housing to the water cooled magnetron and to the bulb.

8. A microwave powered lamp in accordance with claim 7 wherein:

the rate of blowing air through the housing is chosen to maintain operation of the bulb within a temperature range within which the bulb of the lamp is designed to operate and a rate of water flow through the water circulation circuit is chosen to maintain operation of the water cooled magnetron within a temperature range within which the water cooled magnetron is designed to operate.

9. A microwave powered lamp in accordance with claim 2 wherein:

the air source is a single air blower which provides all air blown in the housing to the water cooled magnetron and to the bulb.

10. A microwave powered UV lamp in accordance with claim 9 wherein:

the rate of blowing air through the housing is chosen to maintain operation of the bulb within a temperature range within which the bulb of the lamp is designed to operate and a rate of water flow through the water circulation circuit is chosen to maintain operation of the water cooled magnetron within a temperature range within which the water cooled magnetron is designed to operate.

11. A microwave powered lamp in accordance with claim 3 wherein:

the air source is a single air blower which provides all air blown in the housing to the water cooled magnetron and to the lamp.

12. A microwave powered UV lamp in accordance with claim 11 wherein:

the rate of blowing air through the housing is chosen to maintain operation of the bulb within a temperature range within which the bulb of the lamp is designed to operate and a rate of water flow through the water circulation circuit is chosen to maintain operation of the water cooled magnetron within a temperature range within which the water cooled magnetron is designed to operate.

13. A microwave powered lamp in accordance with claim 4 wherein:

the air source is a single air blower which provides all air blown in the housing to the water cooled magnetron and to the bulb.

14. A microwave powered UV lamp in accordance with claim 13 wherein:

the rate of blowing air through the housing is chosen to maintain operation of the bulb within a temperature range within which the bulb of the lamp is designed to operate and a rate of water flow through the water circulation circuit is chosen to maintain operation of the water cooled magnetron within a temperature range within which the water cooled magnetron is designed to operate.

15. A microwave powered lamp in accordance with claim 5 wherein:

the air source is a single air blower which provides all air blown in the housing to the water cooled magnetron and to the bulb.

16. A microwave powered UV lamp in accordance with claim 15 wherein:

the rate of blowing air through the housing is chosen to maintain operation of the bulb within a temperature range within which the bulb of the lamp is designed to operate and a rate of water flow through the water circulation circuit is chosen to maintain operation of the water cooled magnetron within a temperature range within which the water cooled magnetron is designed to operate.

17. A microwave powered lamp in accordance with claim 6 wherein:

the air source is a single air blower which provides all air blown in the housing to the water cooled magnetron and to the bulb.

18. A microwave powered UV lamp in accordance with claim 17 wherein:

the rate of blowing air through the housing is chosen to maintain operation of the bulb within a temperature range within which the bulb of the lamp is designed to operate and a rate of water flow through the water circulation circuit is chosen to maintain operation of the water cooled magnetron within a temperature range within which the water cooled magnetron is designed to operate.

19. A microwave powered lamp in accordance with claim 1 wherein:

the bulb is a UV bulb.

20. An assembly of microwave powered lamps having the lamps therein in line with each of the microwave powered lamps comprising:

a housing containing a water cooled magnetron, the water cooled magnetron providing microwaves to a microwave excited bulb, the microwave excited bulb providing light from the housing;

an air source, coupled to the housing, which blows air to the water cooled magnetron and the bulb with the air providing cooling to the bulb to control an operational temperature thereof;

a heat exchanger, disposed in the housing, with the air blown from the air source contacting the heat exchanger, the heat exchanger having a portion contacted by water heated by operation of the water cooled magnetron with the air blown from the air source cooling the heated water; and a water circulation circuit, coupled to the water cooled magnetron and the portion of the heat exchanger, which circulates heated water from the water cooled magnetron to the portion of the heat exchanger and cooled water from the portion of the heat exchanger back to the magnetron.

21. An assembly in accordance with claim 20 wherein;

in each microwave powered lamp, the portion of the heat exchanger is a core through which water flows and the heat exchanger is a radiator having openings through which the blown air flows within the housing.

22. An assembly in accordance with claim 20 wherein:

in each microwave powered lamp the water circulation circuit comprises a water pump coupled to a water tank with the heated water being pumped from the water cooled magnetron through a conduit of the water circulation circuit to the portion of the heat exchanger and the cooled water being pumped from the portion of the heat exchanger through a conduit of the water circulation circuit to one of the water tank and the water in the tank and the cooled water being pumped by the pump from the water tank through a conduit of the water circulation circuit to the water cooled magnetron.

23. An assembly in accordance with claim 21 wherein:

in each microwave powered lamp the water circulation circuit comprises a water pump coupled to a water tank with the heated water being pumped from the water cooled magnetron through a conduit of the water circulation circuit to the portion of the heat exchanger and the cooled water being pumped from the portion of the heat exchanger through a conduit of the water circulation circuit to one of the water tank and the water in the tank and the cooled water being pumped by the pump from the water tank through a conduit of the water circulation circuit to the water cooled magnetron.

24. An assembly in accordance with claim 22 wherein:

in each microwave powered lamp, the water pump and water tank are outside the housing.

25. An assembly in accordance with claim 23 wherein:

in each microwave powered lamp, the water pump and water tank are outside the housing.

26. An assembly in accordance with claim 20 wherein:

in each microwave powered lamp, the air source is a single air blower which provides all air blown in the housing to the water cooled magnetron and to the bulb.

27. An assembly in accordance with claim 26 wherein:

in each microwave powered lamp, the rate of blowing air through the housing is chosen to maintain operation of the bulb within a temperature range within which the bulb is designed to operate and a rate of water flow through the water circulation circuit is chosen to maintain operation of the water cooled magnetron within a temperature range within which the water cooled magnetron is designed to operate.

28. An assembly in accordance with claim 21 wherein:

in each microwave powered lamp, the air source is a single air blower which provides all air blown in the housing to the water cooled magnetron and to the bulb.

29. An assembly in accordance with claim 28 wherein;

in each microwave powered lamp, the rate of blowing air through the housing is chosen to maintain operation of the bulb within a temperature range within which the bulb is designed to operate and a rate of water flow through the water circulation circuit is chosen to maintain operation of the water cooled magnetron within a temperature range within which the water cooled magnetron is designed to operate.

30. An assembly in accordance with claim 22 wherein:

in each microwave powered lamp, the air source is a single air blower which provides all air blown in the housing to the water cooled magnetron and to the bulb.

31. An assembly in accordance with claim 30 wherein:

in each microwave powered lamp, the rate of blowing air through the housing is chosen to maintain operation of the bulb within a temperature range within which the bulb is designed to operate and a rate of water flow through the water circulation circuit is chosen to maintain operation of the water cooled magnetron within a temperature range within which the water cooled magnetron is designed to operate.

32. An assembly in accordance with claim 23 wherein:

in each microwave powered lamp. the air source is a single air blower which provides all air blown in the housing to the water cooled magnetron and to the bulb.

33. An assembly in accordance with claim 32 wherein:

in each microwave powered lamp, the rate of blowing air through the housing is chosen to maintain operation of the bulb within a temperature range within which the bulb is designed to operate and a rate of water flow through the water circulation circuit is chosen to maintain operation of the water cooled magnetron within a temperature range within which the water cooled magnetron is designed to operate.

34. An assembly in accordance with claim 24 wherein:

in each microwave powered lamp, the air source is a single air blower which provides all air blown in the housing to the water cooled magnetron and to the bulb.

35. An assembly in accordance with claim 34 wherein:

in each microwave powered lamp, the rate of blowing air through the housing is chosen to maintain operation of the bulb within a temperature range within which the bulb is designed to operate and a rate of water flow through the water circulation circuit is chosen to maintain operation of the water cooled magnetron within a temperature range within which the water cooled magnetron is designed to operate.

36. An assembly in accordance with claim 25 wherein:

in each microwave powered lamp, the air source is a single air blower which provides all air blown in the housing to the water cooled magnetron and to the bulb.

37. An assembly in accordance with claim 36 wherein:

in each microwave powered lamp, the rate of blowing air through the housing is chosen to maintain operation of the bulb within a temperature range within which the bulb is designed to operate and a rate of water flow through the water circulation circuit is chosen to maintain operation of the water cooled magnetron within a temperature range within which the water cooled magnetron is designed to operate.

38. An assembly in accordance with claim 20 wherein:

in each microwave powered lamp the bulb is a UV bulb.

* * * * *